US011821280B2

(12) United States Patent
Poveda et al.

(10) Patent No.: US 11,821,280 B2
(45) Date of Patent: Nov. 21, 2023

(54) REMOTE LOCKING SYSTEM FOR A BLOWOUT PREVENTER

(71) Applicant: SCHLUMBERGER TECHNOLOGY CORPORATION, Sugar Land, TX (US)

(72) Inventors: Sebastien Poveda, Lespignan (FR); Jean-Luc Pujol, Quarante (FR); Nathaniel Pettibone, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 201 days.

(21) Appl. No.: 17/432,533

(22) PCT Filed: Feb. 20, 2020

(86) PCT No.: PCT/EP2020/054442
§ 371 (c)(1),
(2) Date: Aug. 20, 2021

(87) PCT Pub. No.: WO2020/169714
PCT Pub. Date: Aug. 27, 2020

(65) Prior Publication Data

US 2022/0136356 A1 May 5, 2022

Related U.S. Application Data

(60) Provisional application No. 62/808,225, filed on Feb. 20, 2019.

(51) Int. Cl.
*E21B 33/06* (2006.01)
*E21B 34/16* (2006.01)

(52) U.S. Cl.
CPC ..... *E21B 33/062* (2013.01); *E21B 34/16* (2013.01)

(58) Field of Classification Search
CPC ..... E21B 33/062; E21B 34/16; E21B 33/06
See application file for complete search history.

(56) References Cited

U.S. PATENT DOCUMENTS 3,941,141 A 3/1976 Robert
8,978,699 B2 3/2015 Jaffrey et al.
(Continued)

FOREIGN PATENT DOCUMENTS

CN 107676067 B 7/2019
JP WO2009060707 A1 3/2011
WO 2020169714 A1 8/2020

OTHER PUBLICATIONS

Exam Report under Section 18(3) in United Kingdom Patent Application No. GB2111523.3 dated Mar. 14, 2023, 3 pages.
(Continued)

*Primary Examiner* — Nicole Coy
*Assistant Examiner* — Nicholas D Wlodarski
(74) *Attorney, Agent, or Firm* — Kelly McKinney

(57) ABSTRACT

A remote locking system for a blowout preventer (BOP) includes a locking mechanism configured to move to adjust the remote locking system between an unlocked configuration in which the remote locking system enables movement of a ram of the BOP and a locked configuration in which the remote locking system blocks movement of the ram of the BOP. The remote locking system also includes a gear assembly coupled to the locking mechanism, a motor coupled to the gear assembly, and an electronic controller configured to provide a control signal to activate the motor to drive the locking mechanism to move via the gear assembly.

18 Claims, 13 Drawing Sheets

(56) References Cited

U.S. PATENT DOCUMENTS

| | | | | |
|---|---|---|---|---|
| 9,863,206 | B2 | 1/2018 | Biester et al. | |
| 2008/0048140 | A1 | 2/2008 | Whitby et al. | |
| 2008/0099701 | A1* | 5/2008 | Whitby | E21B 33/062 251/1.1 |
| 2013/0264503 | A1 | 10/2013 | Jahnke | |
| 2014/0033842 | A1* | 2/2014 | Morin | E21B 41/00 74/89.17 |
| 2015/0152705 | A1* | 6/2015 | Jaffrey | E21B 33/076 137/553 |
| 2016/0131251 | A1 | 5/2016 | Paisley et al. | |
| 2016/0201423 | A1 | 7/2016 | Biester et al. | |

OTHER PUBLICATIONS

Exam Report under section 18(3) issued in United Kingdom Patent Application No. GB2111523.3 dated Jan. 19, 2023, 3 pages.
Office Action issued in U.S. Appl. No. 17/154,187 dated Apr. 24, 26, 2022, 6 pages.
Notice of Allowance issued in U.S. Appl. No. 17/154,187 dated Oct. 19, 2022, 7 pages.
International Preliminary Report on Patentability of International Patent Application No. PCT/EP2020/054442; 9 pages.
Exam Report under section 18(3) issued in United Kingdom Patent Application No. GB2111523.3 dated May 16, 2022, 2 pages.
International Search Report and Written Opinion issued in International Patent Application No. PCT/EP2020/054442 dated May 7, 2020; 14 pages.

* cited by examiner

REMOTE LOCKING SYSTEM FOR A BLOWOUT PREVENTER

CROSS-REFERENCE TO RELATED APPLICATION

This application claims priority to and the benefit of U.S. Provisional Application No. 62/808,225, entitled "REMOTE LOCKING DEVICE FOR BLOWOUT PREVENTER" filed Feb. 20, 2019. This application is hereby incorporated by reference in its entirety for all purposes.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A blowout preventer (BOP) stack is installed on a wellhead to seal and control an oil and gas well during drilling operations. A drill string may be suspended inside a drilling riser from a rig through the BOP stack into the wellbore. During drilling operations, a drilling fluid is delivered through the drill string and returned up through an annulus between the drill string and a casing that lines the wellbore. In the event of a rapid invasion of formation fluid in the annulus, commonly known as a "kick," a movable component within the BOP stack may be actuated to seal the annulus and to control fluid pressure in the wellbore, thereby protecting well equipment disposed above the BOP stack.

SUMMARY

This summary is provided to introduce a selection of concepts that are further described below in the detailed description. This summary is not intended to identify key or essential features of the claimed subject matter, nor is it intended to be used as an aid in determining or limiting the scope of the claimed subject matter as set forth in the claims.

In some embodiments, a remote locking system for a blowout preventer (BOP) includes a locking mechanism, such that the locking mechanism can be remotely actuated to lock the BOP. In some embodiments, the remote locking system includes a locking mechanism configured to move to adjust the remote locking system between an unlocked configuration in which the remote locking system enables movement of a ram of the BOP and a locked configuration in which the remote locking system blocks movement of the ram of the BOP. The remote locking system also includes a gear assembly coupled to the locking mechanism, a motor coupled to the gear assembly, and an electronic controller configured to provide a control signal to activate the motor to drive the locking mechanism to move via the gear assembly.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
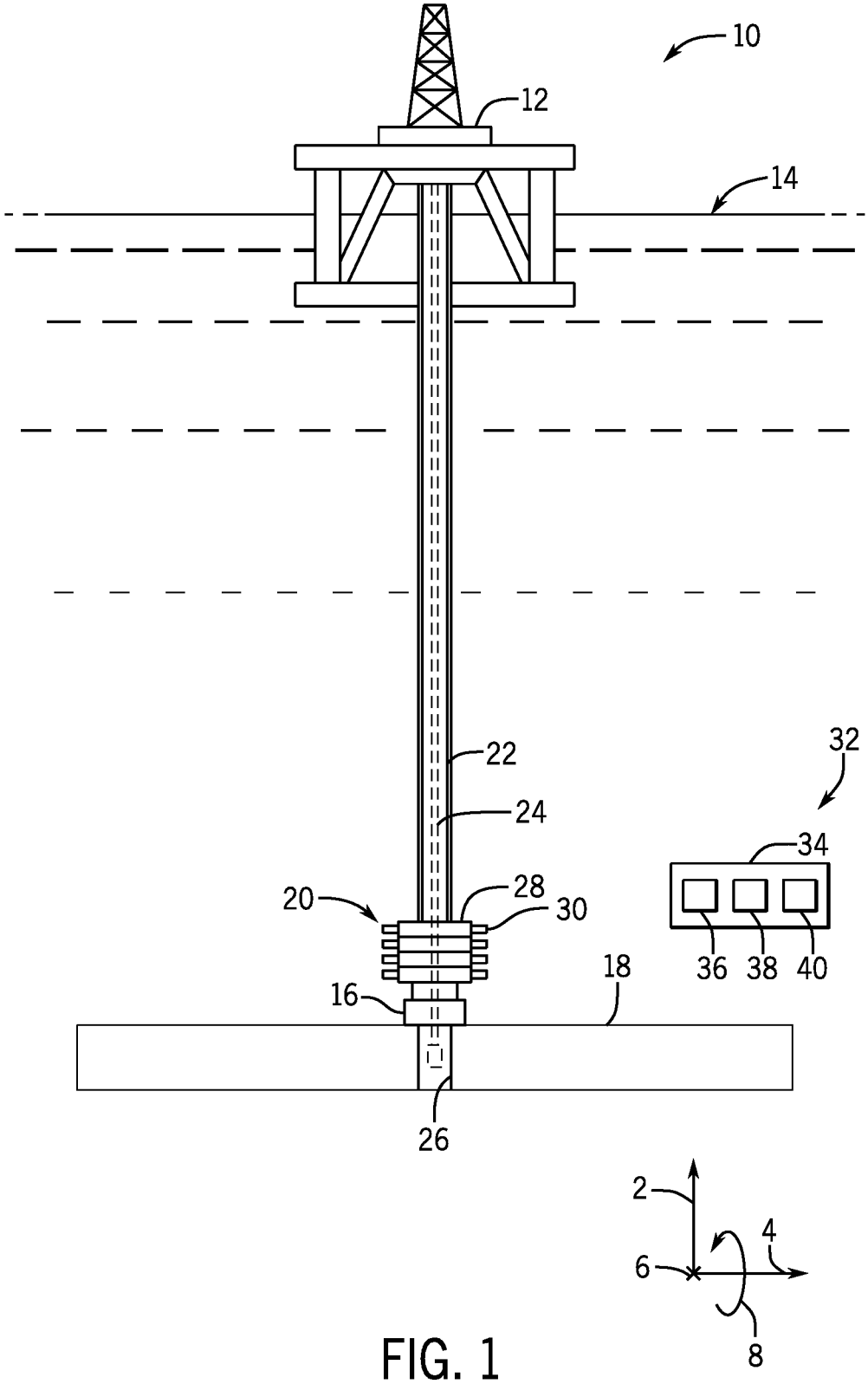
FIG. 1 is a schematic diagram of an offshore system that has a blowout preventer (BOP) and a remote locking system, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present disclosure is generally directed to blowout preventers (BOPs). In particular, the present disclosure is generally directed to a remote locking system for a BOP and/or a method for remote locking of a locking mechanism (e.g., lock screw) for the BOP. The remote locking system may be configured to adjust between an unlocked configuration in which the remote locking system enables movement of rams of the BOP and a locked configuration in which the remote locking system blocks movement of the rams of the BOP.

The BOP is one of the most popular and widely used products to control fluid pressures in a wellbore. A ram-type BOP may generally include a housing, which may be attached to a well casing and which may be provided with a central bore (e.g., a passageway through the BOP) through which a conduit (e.g., drill string) may be passed. Carried in the housing is a pair of rams, which are disposed for reciprocal movement between a retracted position and an extended position. The retracted position corresponds to an open configuration for the BOP, and the extended position corresponds to a closed configuration for the BOP. In the retracted position, an annular area between the conduit and the well casing is open. In the extended position, the rams engage an exterior of the conduit and sealingly close the annular area between the conduit and the well casing.

The rams may each be connected by a respective rod to a respective piston and cylinder assembly carried by the housing. To close the BOP (e.g., to move the rams into the extended position), pressure is applied to the piston and cylinder assembly to thereby force the rams into sealing engagement with the conduit. To open the BOP (e.g., to move the rams into the retracted position), pressure is applied to an opposite end of the piston and cylinder assembly to thereby force the rams out of the central bore.

While the BOP is in the closed configuration, it may be desirable to lock the rams (e.g., to block movement of the rams). Otherwise, extreme pressures would be maintained on the piston and cylinder assemblies of the BOP to hold the BOP in the closed configuration, for example. Some existing BOPs may use a manually operated locking screw that, when screwed in place, engages a portion (e.g., "tail rod" attached to the piston) of the piston of the piston and cylinder assembly, thereby blocking return of the rams to the retracted position.

This type of manually-operated locking screw may require a long period of time to engage the tail rod. Further, operating the manually operated locking screw in certain applications, such as offshore applications, might be impractical or impossible. Finally, decreasing an amount of manually operated devices on or in proximity of a drill floor may be desirable to decrease costs, for example. Accordingly, it is presently recognized that it may be desirable to enable locking of the rams, whether in offshore or in onshore applications, using a remotely operated locking device that could be installed on newly commissioned systems (e.g., drilling systems) and/or retrofitted on already existing systems (e.g., drilling systems).

While certain embodiments disclosed herein relate to an offshore system (e.g., subsea system) to facilitate discussion, it should be understood that the BOP and the remote locking system may be used in an on-shore system (e.g., land-based system). Furthermore, while certain embodiments disclosed herein relate to a drilling system that may be used to carry out drilling operations to facilitate discussion, it should be appreciated that the BOP and the remote locking system may be adapted for use in any of a variety of contexts and during any of a variety of operations. For example, the BOP and the remote locking system may be used in a production system and/or in a pressure control equipment (PCE) stack that is positioned vertically above a wellhead during various intervention operations (e.g., inspection or service operations), such as wireline operations in which a tool supported on a wireline is lowered through the PCE stack to enable inspection and/or maintenance of a well. In such cases, the BOP may be adjusted from the open configuration to the closed configuration (e.g., to seal about the wireline extending through the PCE stack) to isolate the environment, as well as other surface equipment, from pressurized fluid within the well. In the present disclosure, a conduit may be any of a variety of tubular or cylindrical structures, such as a drill string, wireline, Streamline™, slickline, coiled tubing, or other spoolable rod.

FIG. 1 is an embodiment of an offshore system 10 (e.g., offshore drilling system; subsea system). To facilitate discussion, the offshore system 10 and its components may be described with reference to a vertical axis or direction 2, an axial axis or direction 4, a lateral axis or direction 6, and a circumferential axis or direction 8. The offshore system 10 includes a vessel or platform 12 at a sea surface 14 and a wellhead 16 positioned at a sea floor 18. The offshore system 10 also includes a BOP stack 20 positioned above the wellhead 16, and a riser 22 that extends between the BOP stack 20 and the vessel or platform 12. Downhole operations may be carried out by a conduit 24 that extends from the vessel or platform 12, through the riser 22, through the BOP stack 20, through the wellhead 16, and into a wellbore 26.

The BOP stack 20 may include one or more BOPs 28 stacked along the vertical axis 2 relative to one another. One or more of the BOPs 28 may include opposed rams that are configured to move along the axial axis 4 toward and away from one another to adjust the BOP 28 between an open configuration and a closed configuration. In the open configuration, the opposed rams may be retracted (e.g., withdrawn) from a central bore of the BOP 28, and thus, the BOP 28 may enable fluid flow through the central bore. In the closed configuration, the opposed rams may be extended into (e.g., positioned in) the central bore of the BOP 28, and thus, the BOP 28 may block fluid flow through the central bore.

The BOP stack 20 may include any suitable number of BOPs 28. Additionally, the BOP stack 20 may include any of a variety of different types of BOPs 28 (e.g., having shear rams, blind rams, blind shear rams, pipe rams). For example, in certain embodiments, the BOP stack 20 may include one or more BOPs 28 having opposed shear rams or blades configured to sever the conduit 24 to block fluid flow through the central bore and/or one or more BOPs 28 having opposed pipe rams configured to engage the conduit 24 to block fluid flow through the central bore (e.g., through an annulus about the conduit 24).

As shown, the BOP stack 20 may include one or more remote locking assemblies 30 (e.g., remote locking apparatuses). For example, one remote locking assembly 30 may be positioned at each end (e.g., along the axial axis 4) of the BOP 28. The remote locking assembly 30 may be part of a remote locking system 32 that operates to adjust components of the remote locking assembly 30 between an unlocked configuration in which the remote locking assembly 30 enables movement of the rams of the BOP 28 and a locked configuration in which the remote locking assembly 30 blocks movement of the rams of the BOP 28. In operation, while the BOP 28 is in the open configuration, the closed configuration, and/or any position therebetween, the remote locking assembly 30 may be in the locked configuration to maintain the BOP 28 in the open configuration, the closed configuration, and/or the position therebetween. However, the remote locking assembly 30 may be adjusted to the unlocked configuration to enable the rams of the BOP 28 to move relative to the central bore to move between the open configuration and the closed configuration. For example, in response to an indication of an increased pressure within the wellbore 26 or another indication (e.g., operator input; test cycle) that the rams of the BOP 28 should be moved from the open configuration to the closed configuration, the rams of the BOP 28 may be moved from the open configuration to the closed configuration and the remote locking system 32 may operate to adjust the remote locking assembly 30 from the unlocked configuration to the locked configuration to maintain the rams of the BOP in the closed configuration, thereby facilitating maintenance of a seal across the central bore of the BOP 28.

As discussed in more detail below, the remote locking system 32 may include a controller 34 (e.g., electronic controller) having a processor 36 and a memory device 38. In some embodiments, the processor 36 may receive and process signals from a sensor that monitors the pressure within the wellbore 26 to determine that the BOP 28 should be adjusted from the open configuration to the closed configuration (or vice versa). In some embodiments, the processor 36 may receive other signals (e.g., operator input) that indicate that the BOP 28 should be adjusted from the open configuration to the closed configuration (or vice versa). Then, the processor 36 may provide control signals, such as to an actuator assembly to adjust the rams to move toward one another and into the central bore to reach the closed configuration. The processor 36 may also provide control signals, such as to one or more motors (e.g., hydraulic motors, pneumatic motors, electric motors) of the one or more remote locking assemblies 30 to drive adjustment of one or more locking mechanisms (e.g., lock screws) to lock the rams in the closed configuration.

The controller 34 may be part of or include a distributed controller or control system with one or more electronic controllers in communication with one another to carry out the various techniques disclosed herein. For example, the controller 34 may be part of a distributed controller with one controller at the vessel or platform 12 and another controller 34 at the BOP 28 and/or at the remote locking assembly 30. The processor 36 may also include one or more processors configured to execute software, such as software for processing signals and/or controlling other components associated with the remote locking system 32 and/or the BOP 28. The memory device 38 disclosed herein may include one or more memory devices (e.g., a volatile memory, such as random access memory [RAM], and/or a nonvolatile memory, such as read-only memory [ROM]) that may store a variety of information and may be used for various purposes. For example, the memory device 38 may store processor-executable instructions (e.g., firmware or software) for the processor 36 to execute, such as instructions for processing signals and/or controlling the other components associated with the remote locking system 32 and/or the BOP 28. It should be appreciated that the controller 34 may include various other components, such as a communication device 40 that is capable of communicating data or other information to various other devices via a wired and/or a wireless connection.

Advantageously, the remote locking system 32 having the controller 34 enables the one or more remote locking assemblies 30 to be efficiently and remotely locked via electronic control (e.g., without a human operator, a remotely-operated vehicle [ROV], or an autonomously-operated vehicle [AUV] physically contacting and manipulating the one or more remote locking assemblies 30 or the one or more locking mechanism at the BOP 28). The remote locking system 32 herein also enables smooth and/or continuous application of torque to the locking mechanism 70 during an unlocking operation and a locking operation, as opposed to some types of manual operation that may not enable smooth and/or continuous application of torque. Additionally, the remote locking system 32 may provide a visual indicator (e.g., visible to a human operator, a ROV, or an AUV) of a configuration of the one or more remote locking assemblies 30, such as due to respective positions of each of the one or more locking assemblies 30 relative to components of the BOP 28 (e.g., because visible portions of the one or more locking assemblies 30 move relative to components of the BOP 28 during the unlocking operation and the locking operation. The remote locking system 32 may remain coupled to the BOP 28 during operations (e.g., drilling operations) and/or may be a stand-alone component is supported only by to the BOP 28 (e.g., not part of an ROV or an AUV).

Figure 2:
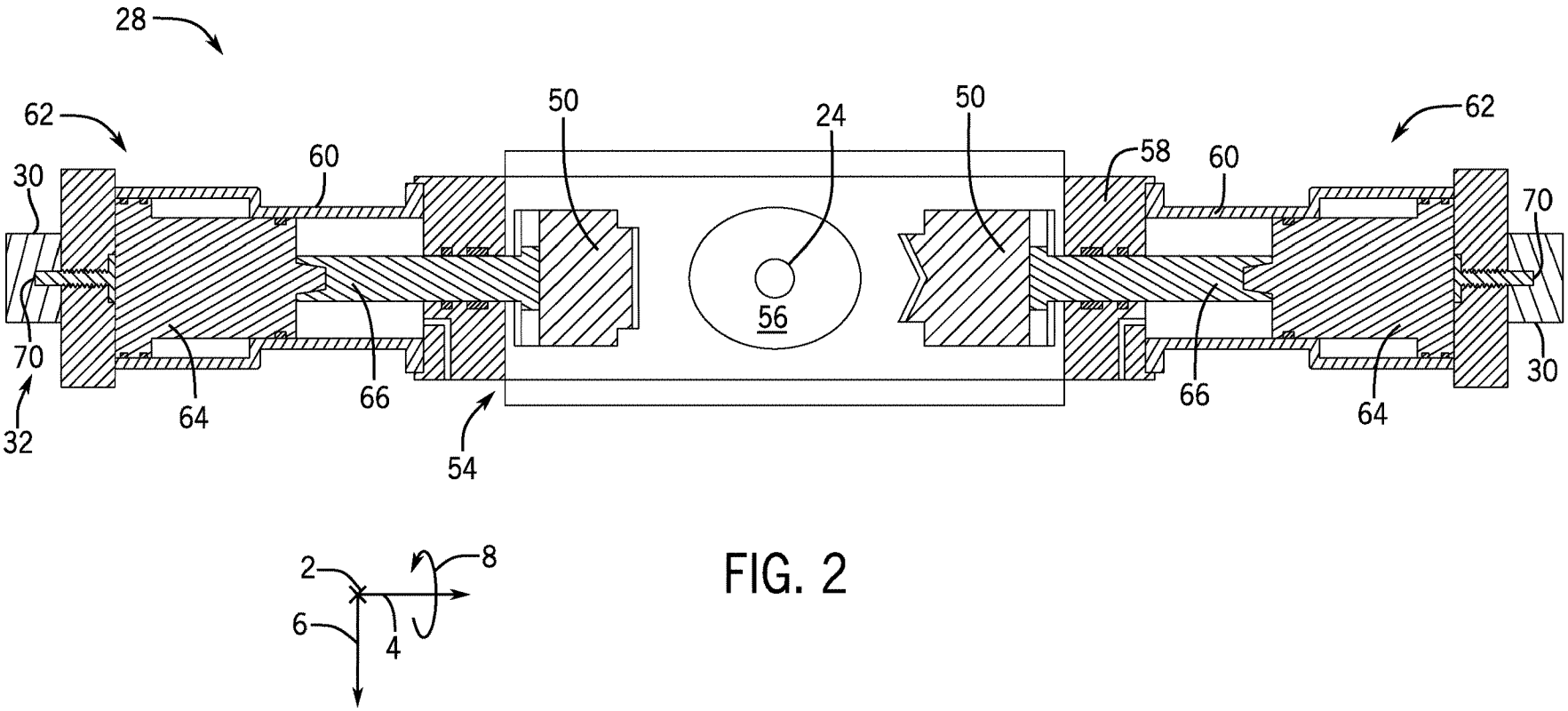
FIG. 2 is a cross-sectional top view of a portion of the BOP and the remote locking system of FIG. 1, in accordance with an embodiment of the present disclosure.

FIG. 2 is a cross-sectional top view of a portion of one BOP 28 with rams 50 in an open configuration 54. In the open configuration 54, the rams 50 are withdrawn from a central bore 56 of the BOP 28, do not contact the conduit 24, and/or do not contact the corresponding opposing ram 50. As shown, the BOP 28 includes a housing 58 (e.g., body) that surrounds and defines the central bore 56. As shown, bonnets 60 (e.g., bonnet assemblies) are mounted to the housing 58 (e.g., via threaded fasteners). Each bonnet 60 supports an actuator 62 (e.g., actuator assembly), which includes a piston 64 and a connecting rod 66. The actuators 62 may drive the rams 50 toward and away from one another along the axial axis 4 and through the central bore 56 to shear the conduit 24 and/or to seal the central bore 56 (e.g., the annular space about the conduit 24).

As shown, a respective remote locking assembly 30 is supported by and/or coupled to each bonnet 60. Each remote locking assembly 30 is configured to adjust (e.g., via actuation, such as hydraulic actuation) from an unlocked configuration in which the remote locking assembly 30 enables movement of one of the rams 50 of the BOP 28 and a locked configuration in which the remote locking assembly 30 blocks movement of the one of the rams 50 of the BOP 28. Each remote locking assembly 30 includes or is configured to drive a locking mechanism 70 (e.g., lock screw; remotely actuated engagement mechanism) that is configured to move relative to the rams 50, the central bore 56, and/or the bonnet 60. In the illustrated embodiment, the locking mechanism 70 is threadably coupled to the bonnet 60 such that rotation of the locking mechanism 70 drives the locking mechanism 70 to move along the axial axis 4 relative to the bonnet 60. For example, the locking mechanism 70 may be rotated in a first direction (e.g., along the circumferential axis 8) to drive the locking mechanism 70 toward the ram 50 and toward the central bore 56 while the ram 50 is in the closed configuration to thereby contact the piston 64 (e.g., a surface of the piston 64, a "tail rod" of the piston 64) and to lock the ram 50 in the closed configuration. The locking mechanism 70 may be rotated in a second direction (e.g., opposite the first direction along the circumferential axis 8) to drive the locking mechanism 70 away the ram 50 and away the central bore 56 to thereby enable the ram 50 to be adjusted from the closed configuration toward the open configuration 54. As shown, a central or rotational axis of the locking mechanism 70 extends along the axial axis 4.

It should be appreciated that the remote locking assembly 30 may not include the locking mechanism 70 (e.g., during manufacture and/or installation of the remote locking assembly 30), and instead, the remote locking assembly 30 may be retrofitted and used with the locking mechanism 70 that is already installed on any of a variety of existing BOPs 28 (e.g., in use and/or installed within the field), such as with the locking mechanism 70 that is configured to be manually operated (e.g., via rotation by a human operator, an ROV, an AUV) in the absence of the remote locking assembly 30. Thus, the remote locking assembly 30 may also be removable (e.g., for maintenance operations, such as inspection, replacement, and/or repair), and the locking mechanism 70 may be manually operated in the absence of the remote locking assembly 30. The remote locking assembly 30 may also include a manual lock feature that enables the locking mechanism 70 to be manually operated even in the presence of the remote locking assembly 30 (e.g., while the remote locking assembly 30 is coupled to the bonnet 60), which may provide for an additional or back-up method of operation to drive the locking mechanism 70 (e.g., in case of hydraulic shortage). For example, an end (e.g., outer end, distal from the central bore 56 shown in FIG. 2) of the locking mechanism 70 may be accessible (e.g., through a cover or a gear housing of the remote locking assembly 30) even while the remote locking assembly 30 is coupled to the bonnet 60 to enable manual rotation of the locking mechanism 70. It should be appreciated the remote locking assembly 30 is configured to be remotely controlled (e.g., via the controller 34 of FIG. 1) to adjust a position of the locking mechanism 70 relative to the bonnet 60.

Figure 3:
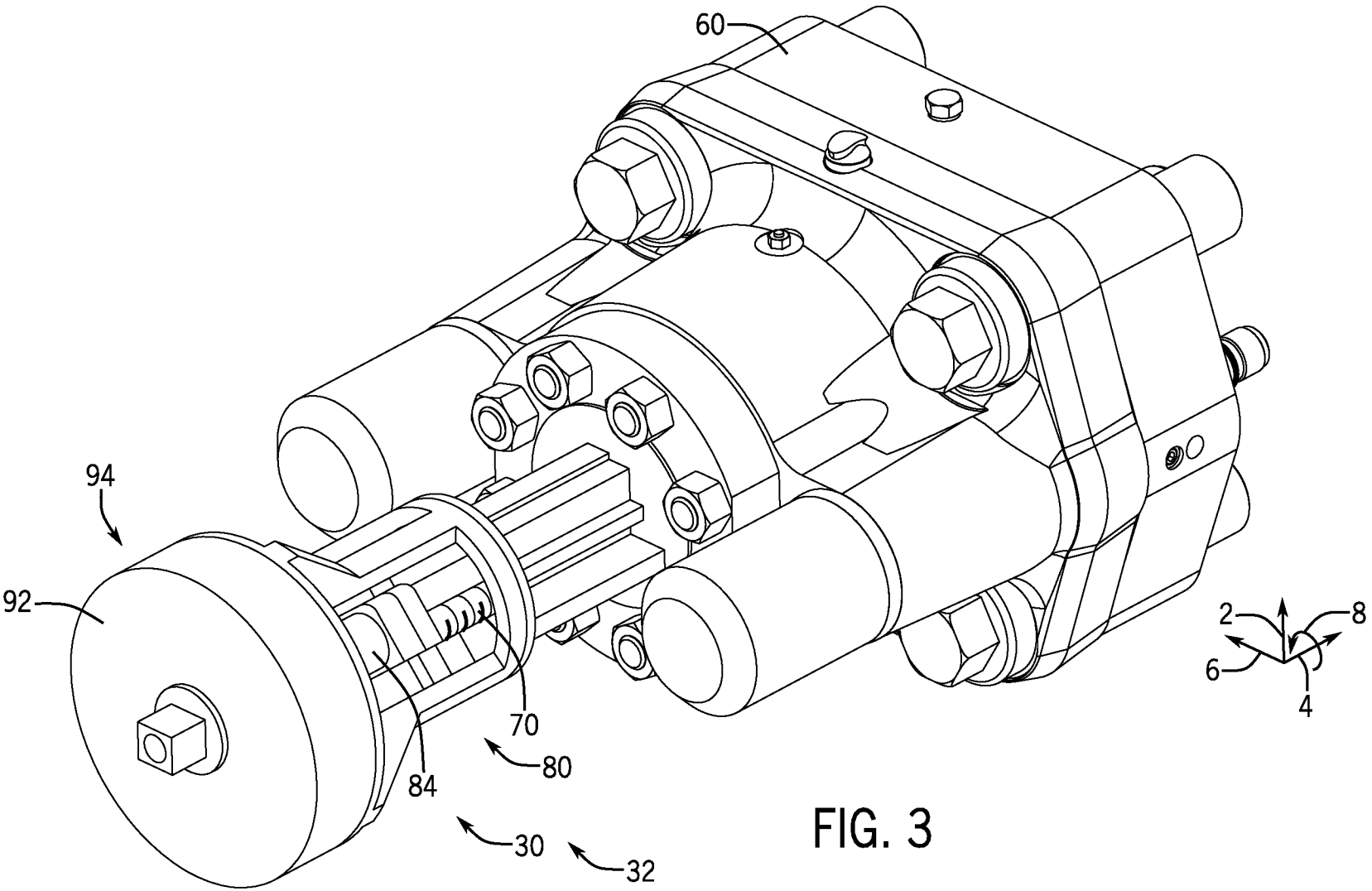
FIG. 3 is a perspective view of a bonnet and a remote locking assembly that may be part of the remote locking system of FIG. 1, wherein the remote locking assembly is in an unlocked position, in accordance with an embodiment of the present disclosure.
Figure 4:
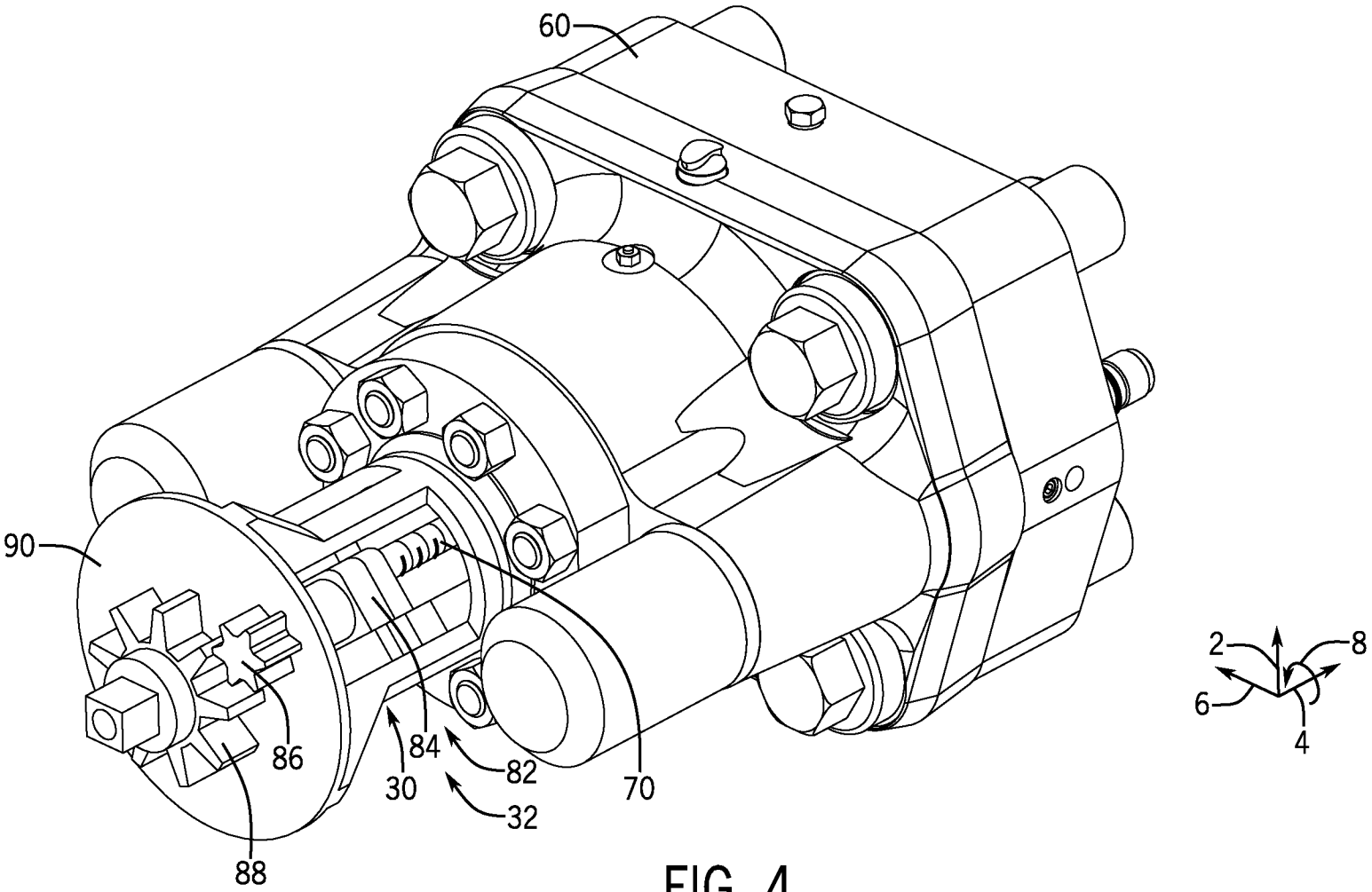
FIG. 4 is a perspective view of the bonnet and the remote locking assembly of FIG. 3, wherein the remote locking assembly is in a locked position, in accordance with an embodiment of the present disclosure.

FIG. 3 is a perspective view of the bonnet 60 and the remote locking assembly 30 that may be part of the remote locking system 32, wherein the remote locking assembly 30 is in an unlocked configuration 80, in accordance with an embodiment of the present disclosure. FIG. 4 is perspective view of the bonnet 60 and the remote locking assembly 30 of FIG. 3, wherein the remote locking assembly 30 is in a locked configuration 82, in accordance with an embodiment of the present disclosure. The sequence of steps for an unlocking operation and a locking operation may also be understood with reference to FIGS. 3 and 4.

As shown, the remote locking assembly 30 includes a motor 84 (e.g., hydraulic motor, pneumatic motor, electric motor) that is coupled to and drives the rotation of the locking mechanism 70 (e.g., via a gear assembly having one or more gears). In particular, the motor 84 may be coupled (e.g., directly, non-rotatably) to a first gear 86 (e.g., spur gear) of the gear assembly (e.g., via an interface between an output shaft of the motor 84 and the first gear 86). The first gear 86 may engage a second gear 88 (e.g., spur gear) of the gear assembly (e.g., via contact between respective teeth of the first gear 86 and the second gear 88). The locking mechanism 70 may be coupled (e.g., directly, non-rotatably) to the second gear 88 of the gear assembly (e.g., via an interface between the locking mechanism 70 and the second gear 88; coaxial). Thus, activation of the motor 84 (e.g., via application of hydraulic pressure in the case of a hydraulic motor) drives rotation of the output shaft of the motor 84, which drives rotation of the first gear 86, which drives rotation of the second gear 88, which drives rotation of the locking mechanism 70. The first gear 86 may have a first diameter, the second gear 88 may have a second diameter, and the first diameter may be less than the second diameter (e.g., to increase torque applied to the locking mechanism 70). It should be appreciated that any of a variety of combinations of gears or similar components may be utilized to transfer torque from the motor 84 to the locking mechanism 70.

As noted above, the rotation of the locking mechanism 70 drives the locking mechanism 70 to move along the axial axis 4 relative to the bonnet 60. For example, the rotation of the locking mechanism 70 in a first direction along the circumferential axis 8 may drive the locking mechanism 70 along the axial axis 4 toward the central bore 56 (FIG. 2) to move from the unlocked configuration 80 of FIG. 3 to the locked configuration 82 of FIG. 4. Similarly, the rotation of the locking mechanism 70 in a second direction (e.g., opposite the first direction) along the circumferential axis 8 may drive the locking mechanism 70 along the axial axis 4 away from the central bore 56 (FIG. 2) to move from the locked configuration 82 of FIG. 4 to the unlocked configuration 80 of FIG. 3. As shown, the remote locking assembly 30 (e.g., the motor 84, the gear assembly) may move with the locking mechanism 70 along the axial axis 4 relative to the bonnet 60. A central or rotational axis of the output shaft of the motor 84 is parallel to a central or rotational axis of the locking mechanism 70.

As shown, the remote locking assembly 30 may include certain features that provide a compact structure. For example, in the illustrated embodiment, the motor 84 is positioned between an end (e.g., outer end, distal from the central bore 56 shown in FIG. 2) of the locking mechanism 70 and components of the bonnet 60 (e.g., the piston 64 of the bonnet 60, as shown in FIG. 2) along the axial axis 4. The remote locking assembly 30 is also positioned within a lateral extent of the bonnet 60 (e.g., does not extend outwardly from the bonnet 60 along the lateral axis 6) and/or within a vertical extend of the bonnet 60 (e.g., does not extend outwardly from the bonnet 60 along the vertical axis 2). Additionally, the output shaft of the motor 84 may extend through an end plate 90 of the remote locking assembly 30 to interface with the first gear 86. As shown in FIG. 3, the end plate 90 may couple to an end cover 92 to form a gear housing 94 that supports and/or encloses the first gear 86 and the second gear 88. The end cover 92 is removed in FIG. 4 to more clearly illustrate the first gear 86 and the second gear 88.

Figure 5:
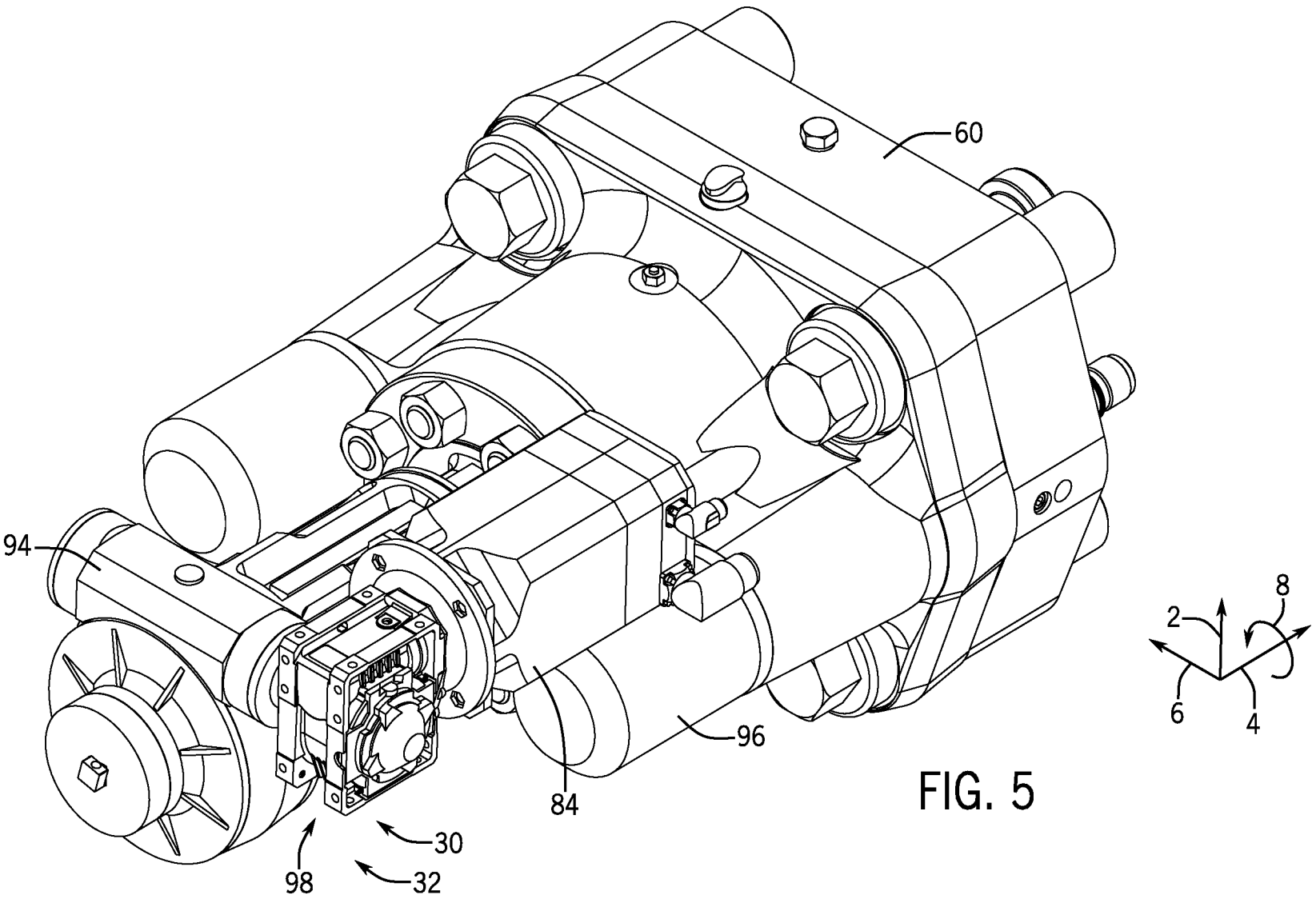
FIG. 5 is a perspective view of a bonnet and a remote locking assembly that may be part of the remote locking system of FIG. 1, in accordance with an embodiment of the present disclosure.
Figure 7:
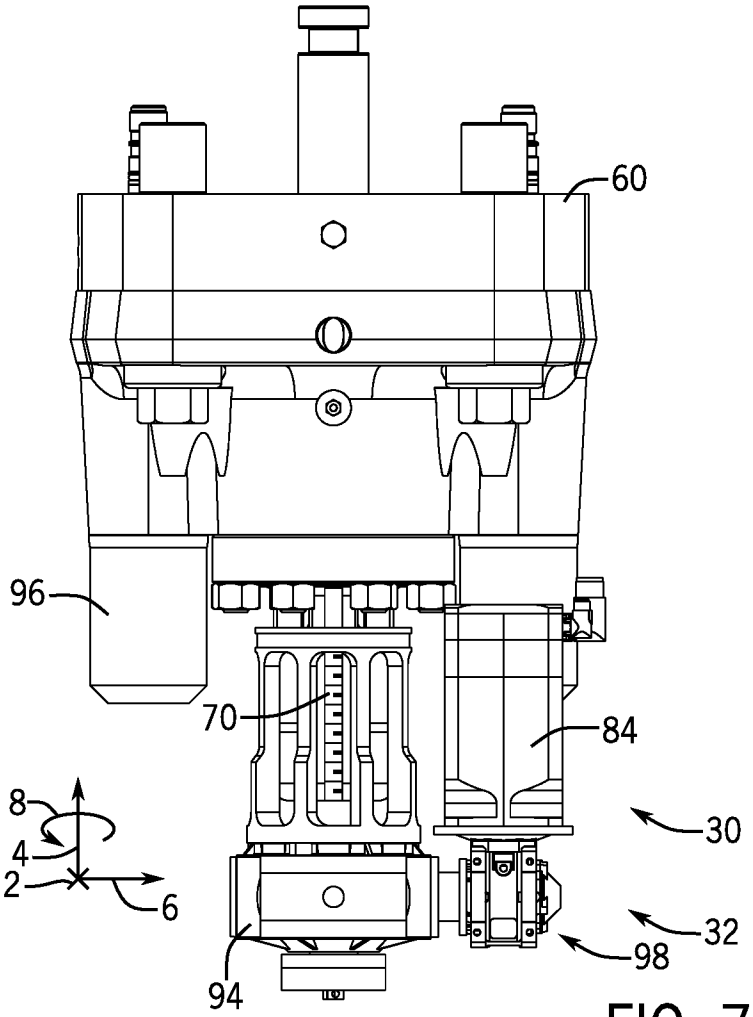
FIG. 7 is a top view of the bonnet and the remote locking assembly of FIG. 5, wherein the remote locking assembly is in a locked position, in accordance with an embodiment of the present disclosure.
Figure 6:
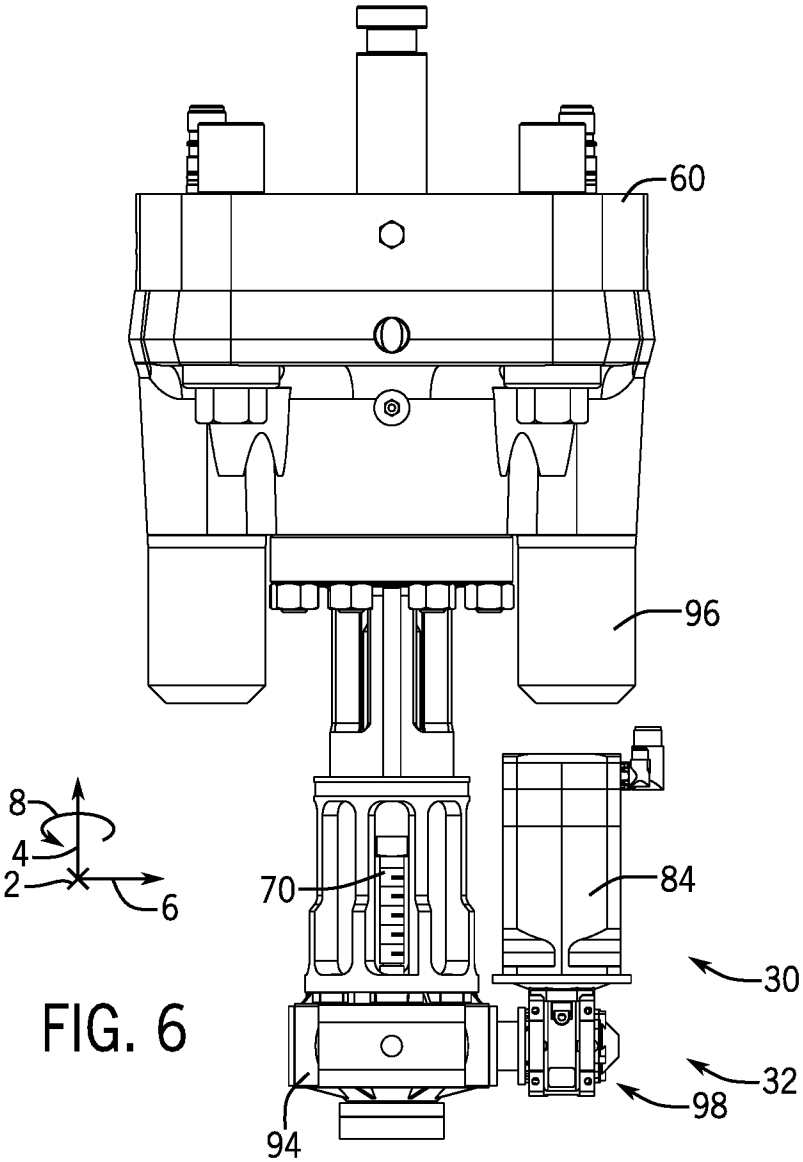
FIG. 6 is a top view of the bonnet and the remote locking assembly of FIG. 5, wherein the remote locking assembly is in an unlocked position, in accordance with an embodiment of the present disclosure.
Figure 8:
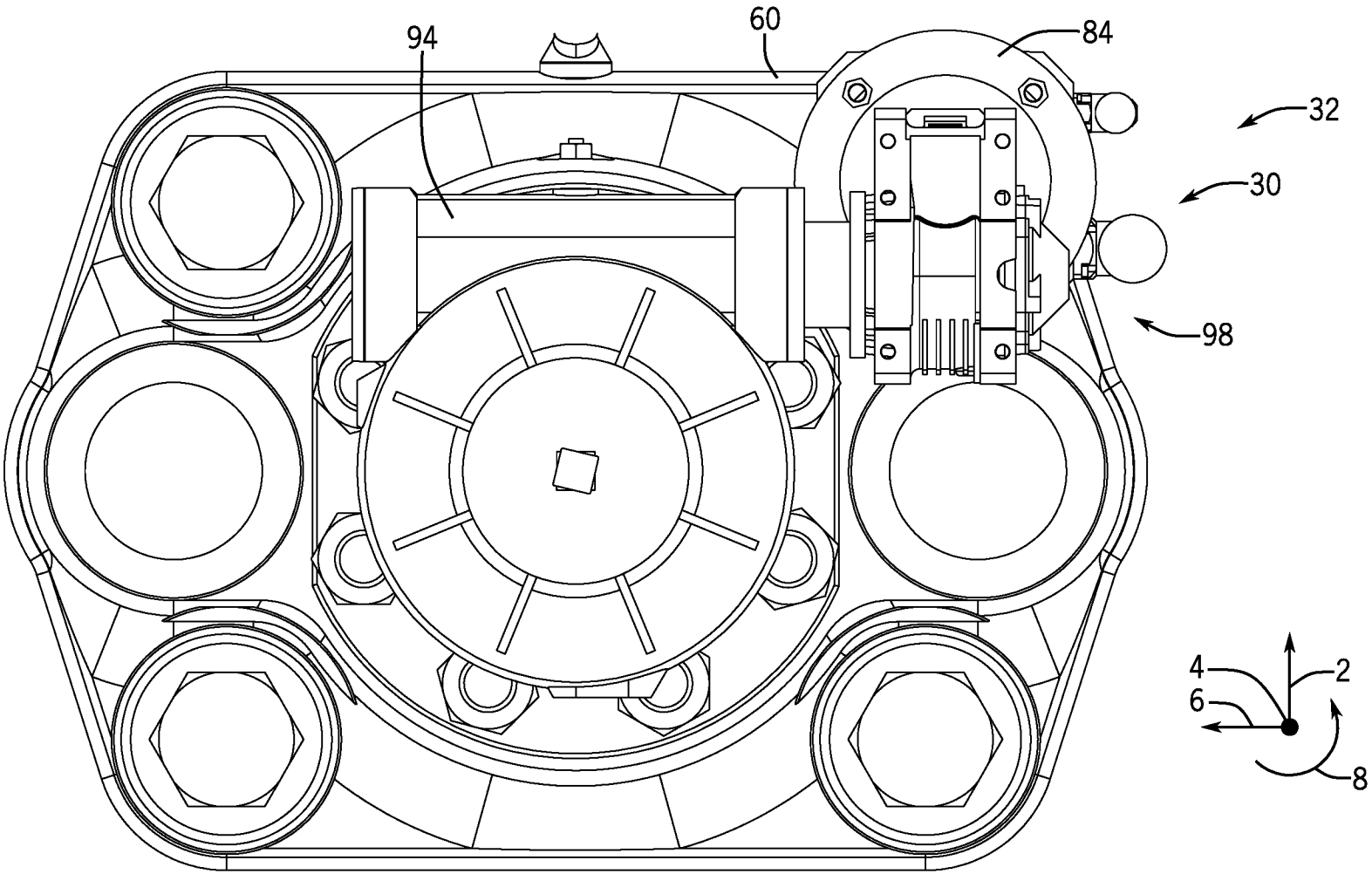
FIG. 8 is an end view of the bonnet and the remote locking assembly of FIG. 5, in accordance with an embodiment of the present disclosure.

FIG. 5 is a perspective view of the bonnet 60 and the remote locking assembly 30 that may be part of the remote locking system 32, in accordance with an embodiment of the present disclosure. FIG. 6 is a top view of the bonnet 60 and the remote locking assembly 30 of FIG. 5, wherein the remote locking assembly 30 is in the unlocked position 80, in accordance with an embodiment of the present disclosure. FIG. 7 is a top view of the bonnet 60 and the remote locking assembly 30 of FIG. 5, wherein the remote locking assembly 30 is in the locked position 82, in accordance with an embodiment of the present disclosure. FIG. 8 is an end view of the bonnet 60 and the remote locking assembly 30 of FIG. 5, in accordance with an embodiment of the present disclosure. The sequence of steps for an unlocking operation and a locking operation may also be understood with reference to FIGS. 6 and 7.

As shown, the remote locking assembly 30 includes the motor 84 (e.g., hydraulic motor, pneumatic motor, electric motor) that is coupled to and drives the rotation of the locking mechanism 70 (e.g., via a gear assembly having one or more gears). Thus, activation of the motor 84 (e.g., via application of hydraulic pressure in the case of a hydraulic motor) drives rotation of the output shaft of the motor 84, which drives rotation of the gear assembly, which drives rotation of the locking mechanism 70. It should be appreciated that any of a variety of combinations of gears or similar components may be utilized to transfer torque from the motor 84 to the locking mechanism 70.

As noted above, the rotation of the locking mechanism 70 drives the locking mechanism 70 to move along the axial axis 4 relative to the bonnet 60. For example, the rotation of the locking mechanism 70 in a first direction along the circumferential axis 8 may drive the locking mechanism 70 along the axial axis 4 toward the central bore 56 (FIG. 2) to move from the unlocked configuration 80 of FIG. 6 to the locked configuration 82 of FIG. 7. Similarly, the rotation of the locking mechanism 70 in a second direction along the circumferential axis 8 may drive the locking mechanism 70 along the axial axis 4 away from the central bore 56 (FIG. 2) to move from the locked configuration 82 of FIG. 7 to the unlocked configuration 80 of FIG. 6.

As shown, the remote locking assembly 30 may include certain features that provide a compact structure. For example, in the illustrated embodiment, the motor 84 is positioned between an end (e.g., outer end, distal from the central bore 56 shown in FIG. 2) of the locking mechanism 70 and components of the bonnet 60 (e.g., the piston 64 of the bonnet 60, as shown in FIG. 2) along the axial axis 4. The remote locking assembly 30 is also substantially positioned within a lateral extent of the bonnet 60 (e.g., does not extend outwardly from the bonnet 60 along the lateral axis 6) and is also substantially positioned within a vertical extent of the bonnet 60 (e.g., does not extend outwardly from the bonnet 60 along the vertical axis 2). As shown, the gear housing 94 may support and/or enclose the gear assembly. The remote locking assembly 30 may have a bend (e.g., approximately 90 degrees), such as a bend between an output shaft of the motor 84 (e.g., a central or rotational axis of the output shaft of the motor 84 extends along a first axis, such as the axial axis 4) and a portion of the gear assembly (e.g., a central or rotational axis of at least one of the components of the gear assembly extends along a second axis, such as the lateral axis 6). The bend 98 may be provided by a bevel gear arrangement or any other suitable structure. As shown, a central or rotational axis of the output shaft of the motor 84 is parallel to a central or rotational axis of the locking mechanism 70.

As shown, the remote locking assembly 30 (e.g., the motor 84, the gear assembly) may move with the locking mechanism 70 along the axial axis 4 relative to the bonnet 60. The motor 84 may be offset with respect to fasteners 96 of the bonnet 60 so as to avoid contact with the fasteners 96 as the remote locking assembly 30 moves with the locking mechanism 70 along the axial axis 4 toward the central bore 56 of FIG. 2 (e.g., while the remote locking assembly 30 locks the BOP 28 in the closed configuration, such as in FIG. 7). For example, the motor 84 is offset along the vertical axis 2 with respect to the fasteners 96.

Figure 9:
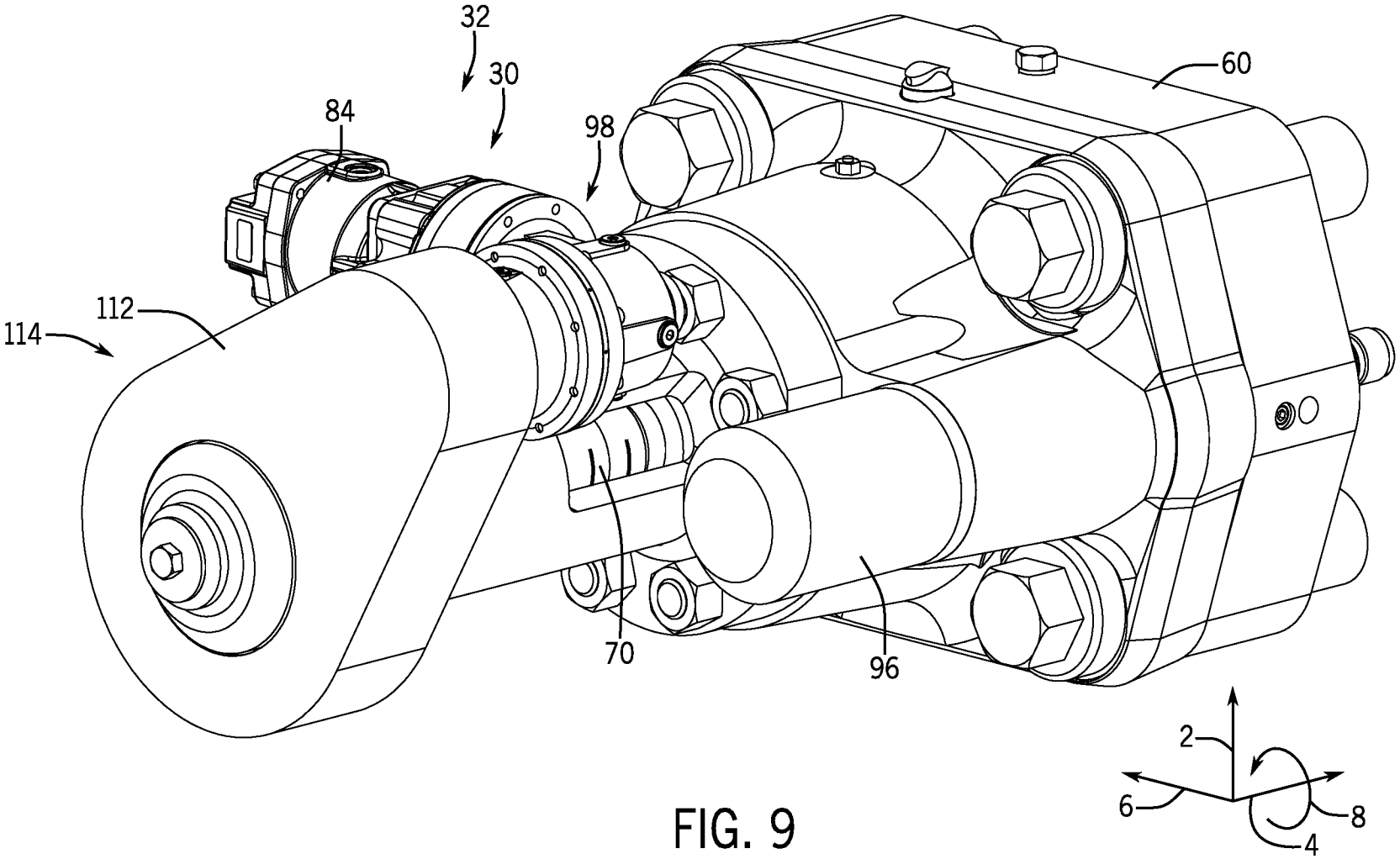
FIG. 9 is a perspective view of a bonnet and a remote locking assembly that may be part of the remote locking system of FIG. 1, in accordance with an embodiment of the present disclosure.
Figure 10:
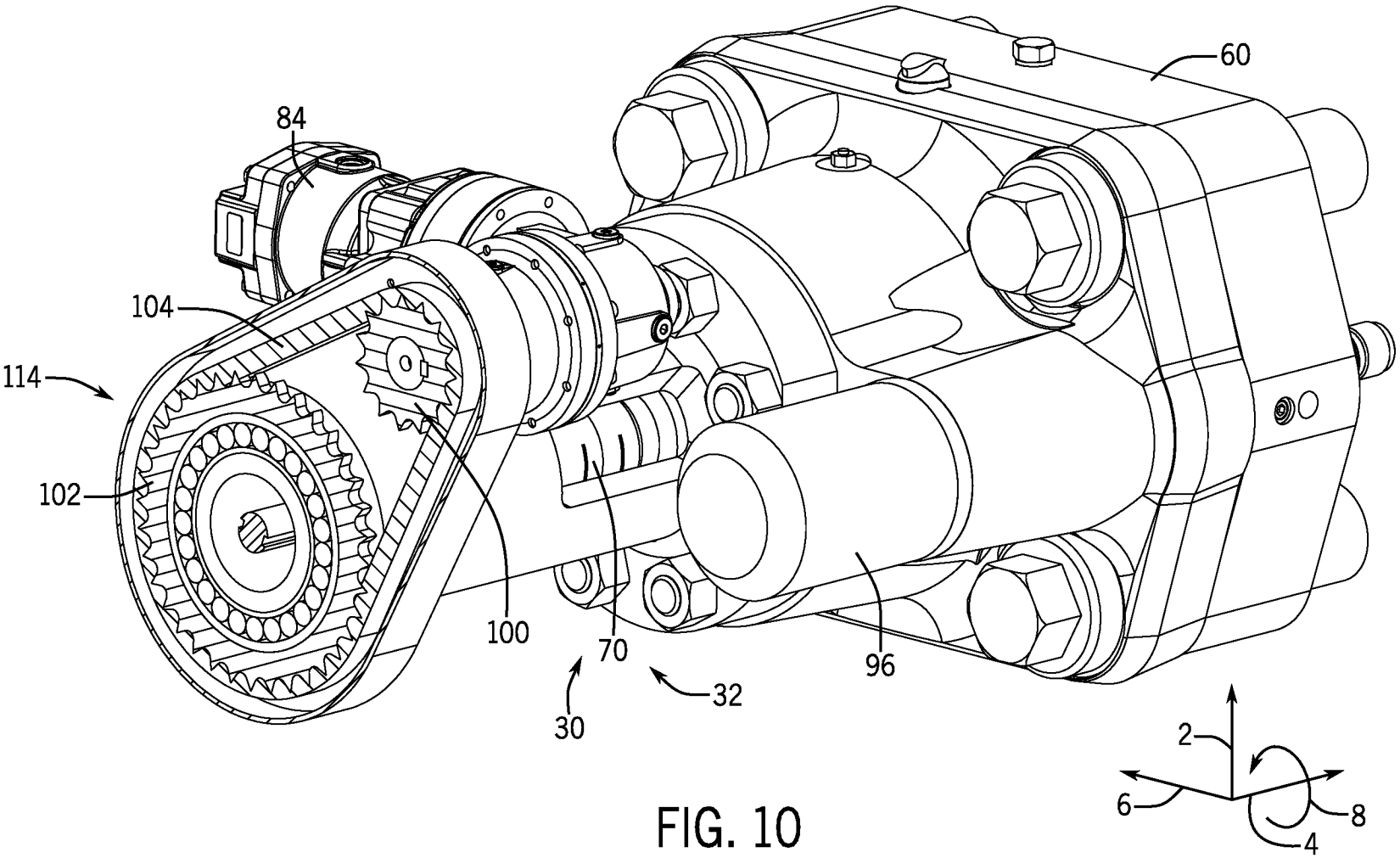
FIG. 10 is a perspective view of the bonnet and the remote locking assembly of FIG. 9, wherein a portion of a gear housing is removed to illustrate a portion of a gear assembly of the remote locking assembly, in accordance with an embodiment of the present disclosure.
Figure 11:
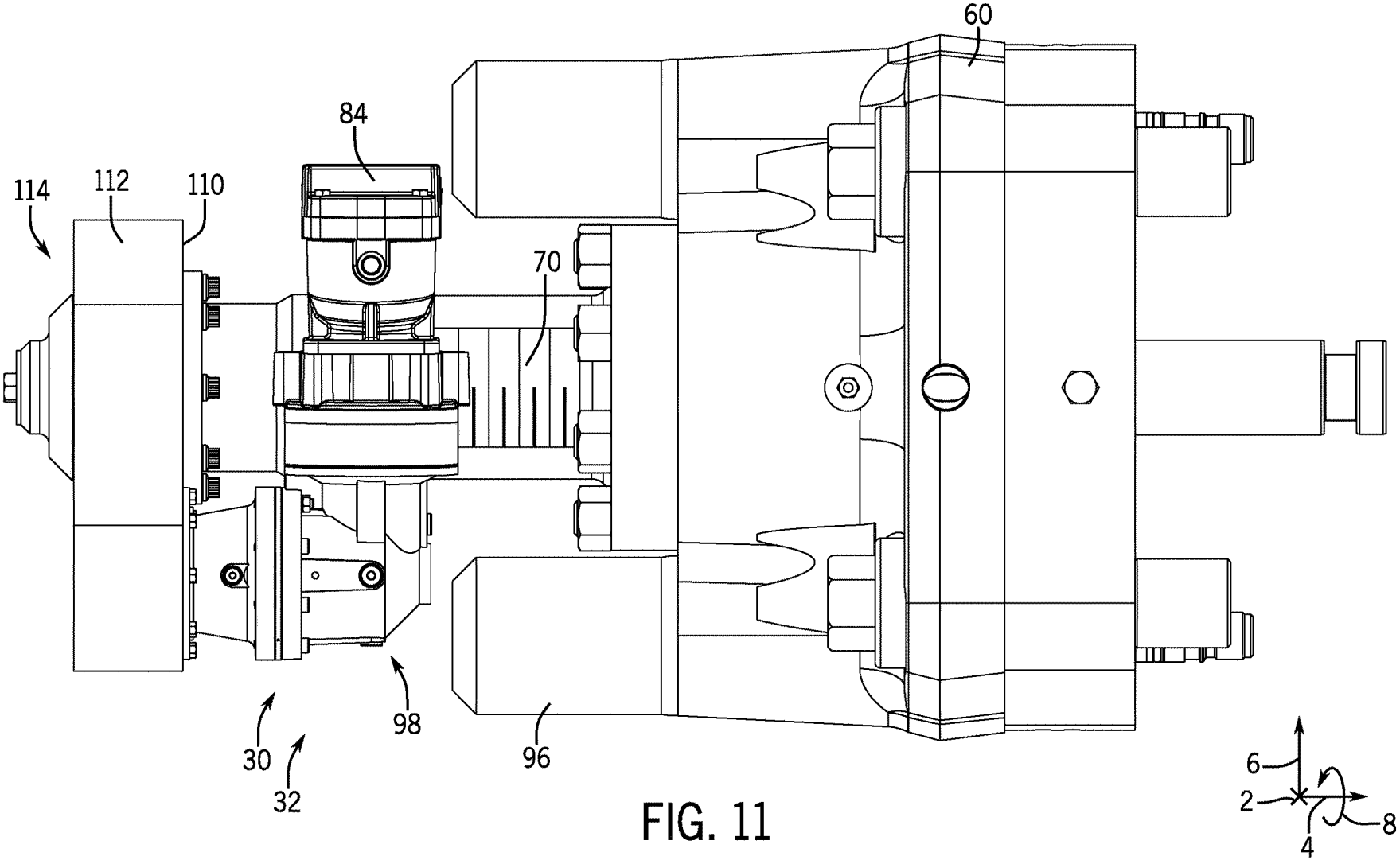
FIG. 11 is a top view of the bonnet and the remote locking assembly of FIG. 9, in accordance with an embodiment of the present disclosure.
Figure 12:
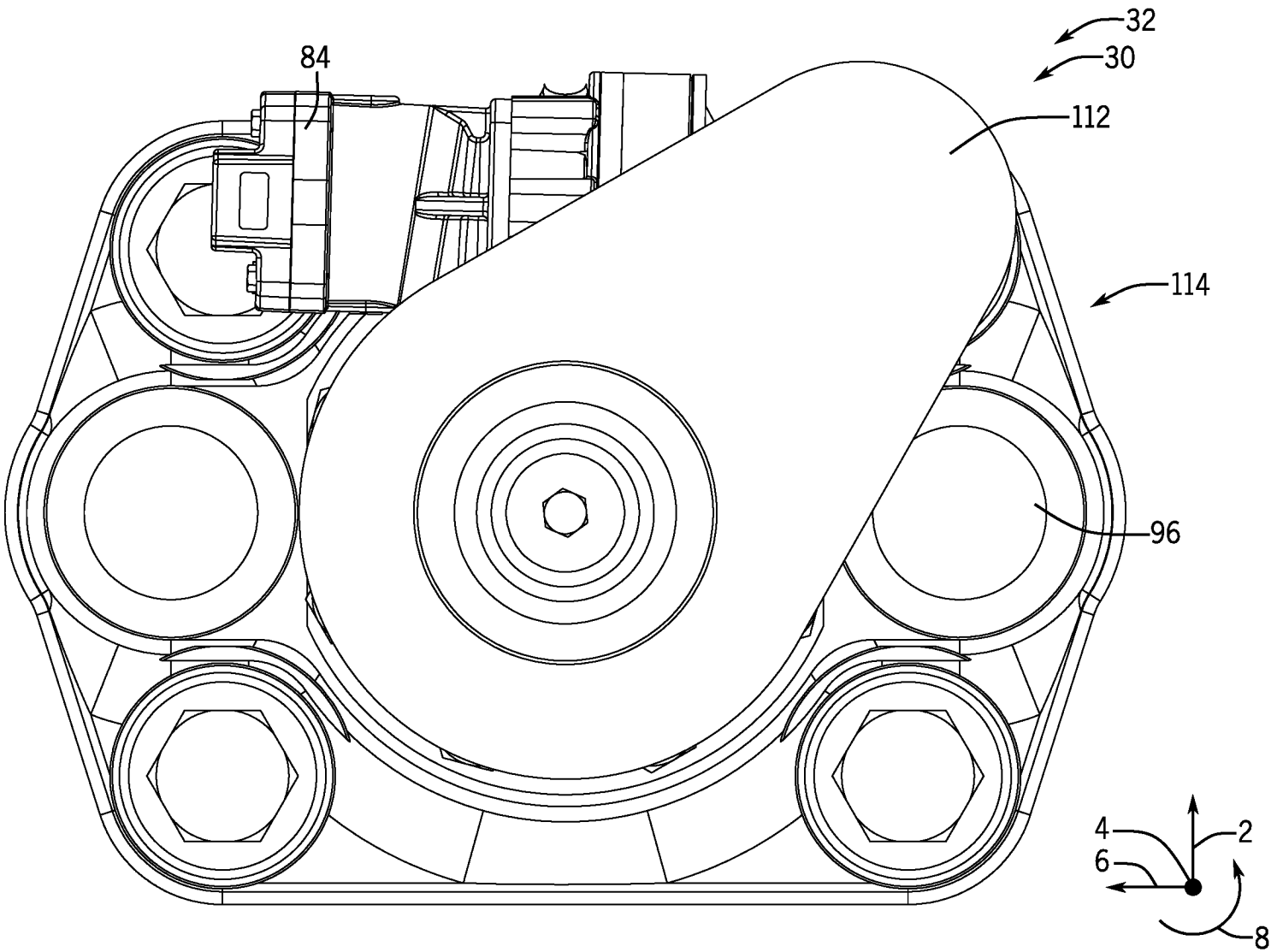
FIG. 12 is an end view of the bonnet and the remote locking assembly of FIG. 9, in accordance with an embodiment of the present disclosure.

FIG. 9 is a perspective view of the bonnet 60 and the remote locking assembly 30 that may be part of the remote locking system 32, in accordance with an embodiment of the present disclosure. FIG. 10 is a perspective view of the bonnet and the remote locking assembly of FIG. 9, wherein a portion of a gear housing 114 is removed to illustrate a portion of a gear assembly of the remote locking assembly 30, in accordance with an embodiment of the present disclosure. FIG. 11 is a top view of the bonnet 60 and the remote locking assembly 30 of FIG. 9, in accordance with an embodiment of the present disclosure. FIG. 12 is an end view of the bonnet 60 and the remote locking assembly 30 of FIG. 9, in accordance with an embodiment of the present disclosure.

As shown, the remote locking assembly 30 includes the motor 84 (e.g., hydraulic motor, pneumatic motor, electric motor) that is coupled to and drives the rotation of the locking mechanism 70 (e.g., via a gear assembly having one or more gears and/or one or more belts). In particular, as best shown in FIG. 10, the motor 84 may be coupled (e.g., indirectly, non-rotatably via one or more gears) to a first gear 100 (e.g., spur gear) of the gear assembly (e.g., via one or more gears, such as between an interface between an output shaft of the motor 84 and one gear and one or more interfaces between additional gears). The first gear 100 may drive a second gear 102 (e.g., spur gear) of the gear assembly (e.g., via a belt 104, which contacts and engages respective teeth of the first gear 100 and the second gear 102).

The locking mechanism 70 may be coupled (e.g., directly, non-rotatably) to the second gear 102 of the gear assembly (e.g., via an interface between the locking mechanism 70 and the second gear 102; coaxial). Thus, activation of the motor 84 (e.g., via application of hydraulic pressure in the case of a hydraulic motor) drives rotation of the output shaft of the motor 84, which indirectly drives rotation of the first gear 100, which drives rotation of the second gear 102, which drives rotation of the locking mechanism 70. The first gear 100 may have a first diameter, the second gear 102 may have a second diameter, and the first diameter may be less than the second diameter (e.g., to increase torque applied to the locking mechanism 70). It should be appreciated that any of a variety of combinations of gears or similar components may be utilized to transfer torque from the motor 84 to the locking mechanism 70.

As noted above, the rotation of the locking mechanism 70 drives the locking mechanism 70 to move along the axial axis 4 relative to the bonnet 60. For example, the rotation of the locking mechanism 70 in a first direction along the circumferential axis 8 may drive the locking mechanism 70 along the axial axis 4 toward the central bore 56 (FIG. 2) to move from the unlocked configuration to the locked configuration. Similarly, the rotation of the locking mechanism 70 in a second direction along the circumferential axis 8 may drive the locking mechanism 70 along the axial axis 4 away from the central bore 56 (FIG. 2) to move from the locked configuration to the unlocked configuration.

As shown, the remote locking assembly 30 may include certain features that provide a compact structure. For example, in the illustrated embodiment, the motor 84 is positioned between an end (e.g., outer end, distal from the central bore 56 shown in FIG. 2) of the locking mechanism 70 and components of the bonnet 60 (e.g., the piston 64 within the bonnet 60, as shown in FIG. 2) along the axial axis 4. The remote locking assembly 30 is positioned within a lateral extent of the bonnet 60 (e.g., does not extend outwardly from the bonnet 60 along the lateral axis 6) and is also positioned within a vertical extent of the bonnet 60 (e.g., does not extend outwardly from the bonnet 60 along the vertical axis 2). The remote locking assembly 30 may have the bend 98 (e.g., approximately 90 degrees), such as a bend between an output shaft of the motor 84 (e.g., a central or rotational axis of the output shaft of the motor 84 extends along the vertical axis 4) and a portion of the gear assembly (e.g., a central or rotational axis of at least one of the gears of the gear assembly extends along the axial axis 6). The bend 98 may be provided by a bevel gear arrangement or any other suitable structure. As shown, a central or rotational axis of the output shaft of the motor 84 is transverse (e.g., orthogonal) to a central or rotational axis of the locking mechanism 70.

Additionally, an end plate 110 may couple to an end cover 112 to form the gear housing 114 that supports and/or encloses the first gear 100, the second gear 102, and the belt 104. As noted above, the end cover 112 is removed in FIG. 10 to more clearly illustrate the first gear 100, the second gear 102, and the belt 104. In this way, the gear housing 114 may support and/or enclose the gear assembly. As shown, the remote locking assembly 30 (e.g., the motor 84, the gear assembly) may move with the locking mechanism 70 along the axial axis 4 relative to the bonnet 60. The motor 84 is also offset with respect to fasteners 96 of the bonnet 60 so as to avoid contact with the fasteners 96 as the remote locking assembly 30 moves with the locking mechanism 70 along the axial axis 4 toward the central bore 56 of FIG. 2 (e.g., while the remote locking assembly 30 locks the BOP 28 in the closed configuration). For example, the motor 84 is offset along the vertical axis 2 with respect to the fasteners 96.

Figure 13:
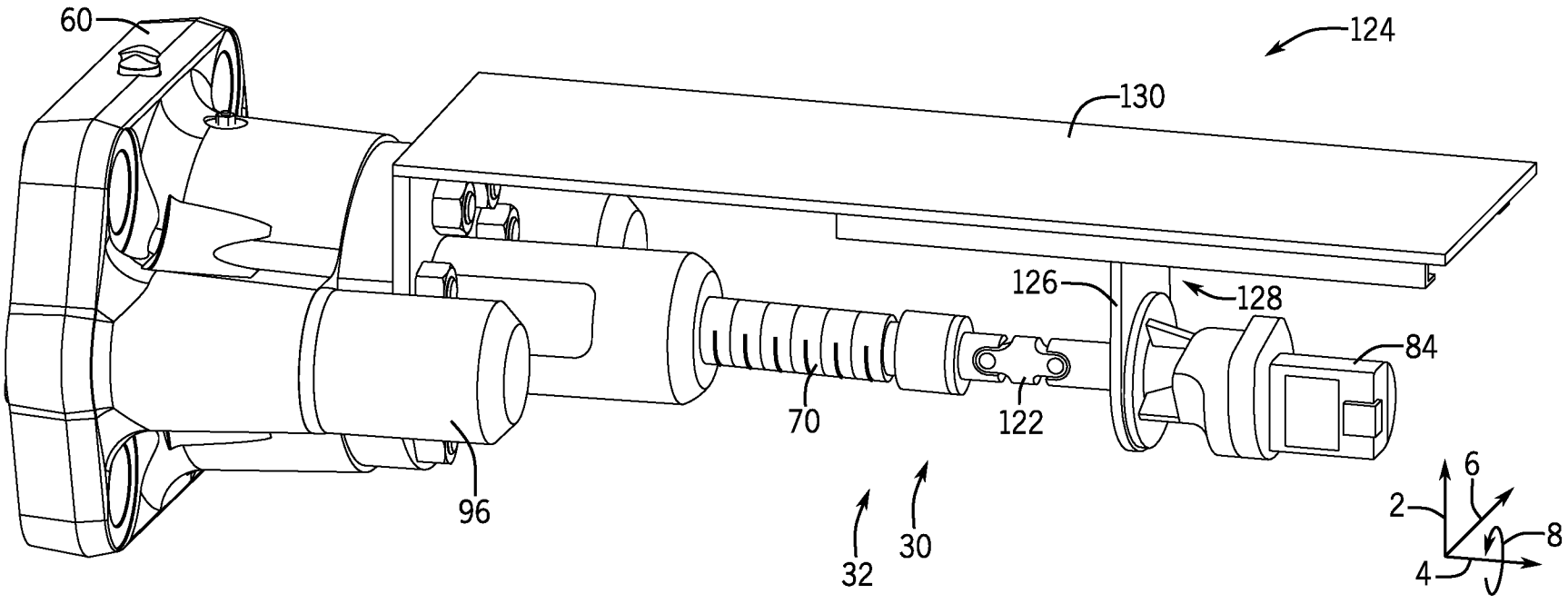
FIG. 13 is a perspective side view of the bonnet and the remote locking assembly that may be part of the remote locking system of FIG. 1, wherein the remote locking assembly includes a carriage system, in accordance with an embodiment of the present disclosure.
Figure 14:
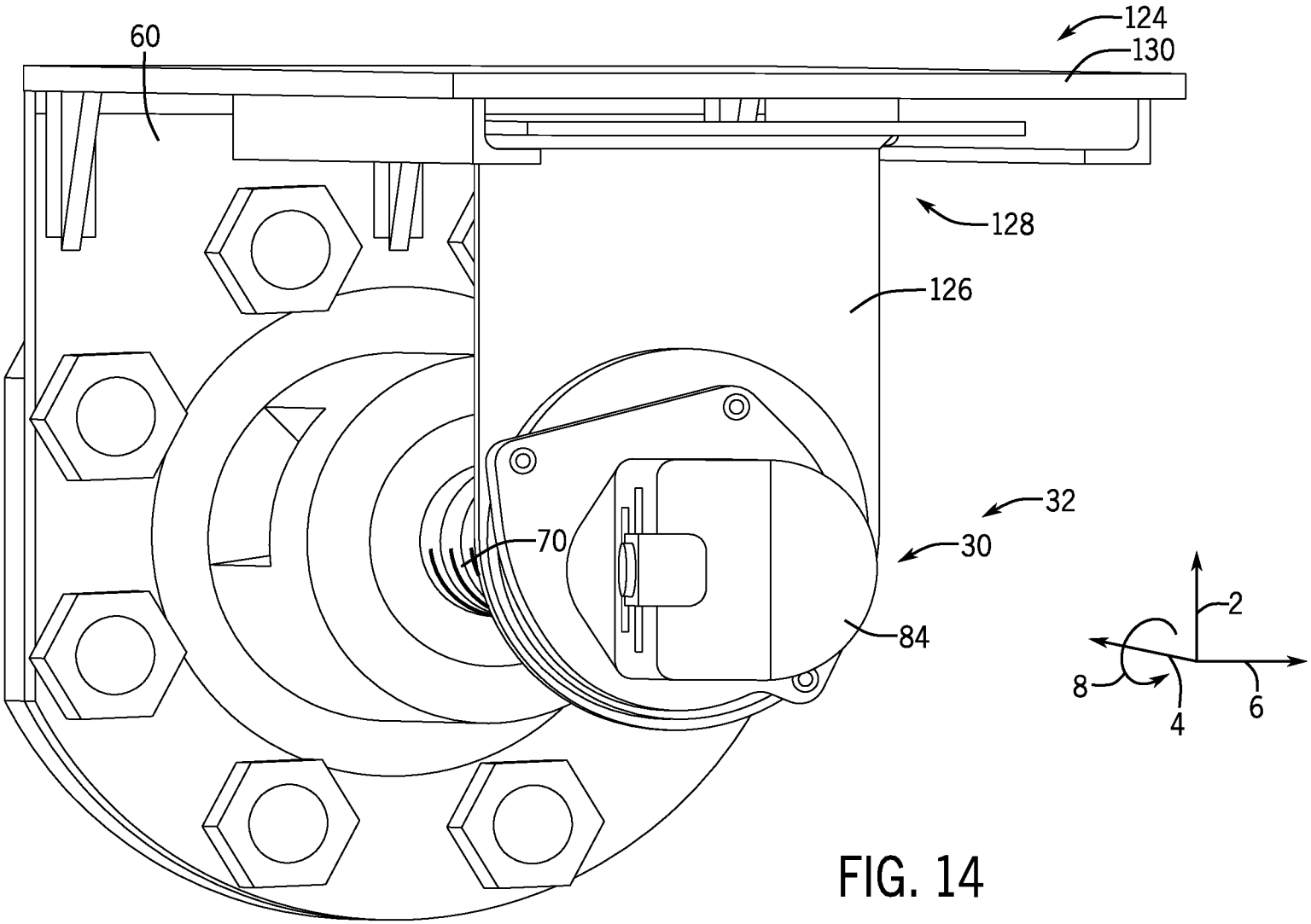
FIG. 14 is a perspective end view of the bonnet and the remote locking assembly of FIG. 13, in accordance with an embodiment of the present disclosure.

FIG. 13 is a perspective side view of the bonnet 60 and the remote locking assembly 30 with a carriage system 124, in accordance with an embodiment of the present disclosure. FIG. 14 is a perspective end view of the bonnet 60 and the remote locking assembly 30 with the carriage system 124, in accordance with an embodiment of the present disclosure.

As shown, the remote locking assembly 30 includes the motor 84 (e.g., hydraulic motor, pneumatic motor, electric motor) that is coupled to and drives the rotation of the locking mechanism 70 via a connector 122. The connector 122 may be configured to maintain alignment between an output shaft of the motor 84 and the locking mechanism 70 (e.g., to maintain alignment between respective central or rotational axes) during an unlocking operation and a locking operations. For example, the connector 122 may be a universal joint (e.g., U-joint, such as a double U-joint having two U-joints joined by an intermediate shaft) that is configured to maintain the alignment.

Activation of the motor 84 drives rotation of the output shaft of the motor 84, which drives rotation of the connector 122 and the locking mechanism 70 coupled thereto. As noted above, the rotation of the locking mechanism 70 causes the locking mechanism 70 to move along the axial axis 4 relative to the bonnet 60. For example, the rotation of the locking mechanism 70 in a first direction along the circumferential axis 8 may drive the locking mechanism 70 along the axial axis 4 toward the central bore 56 (FIG. 2) to move from the unlocked configuration to the locked configuration. Similarly, the rotation of the locking mechanism 70 in a second direction along the circumferential axis 8 may drive the locking mechanism 70 along the axial axis 4 away from the central bore 56 (FIG. 2) to move from the locked configuration to the unlocked configuration.

A portion of the remote locking assembly 30 (e.g., the motor 84 and the connector 122) may move with the locking mechanism 70 along the axial axis 4 relative to the bonnet 60. As shown, the remote locking assembly 30 may include a carriage system 124 that supports (e.g., slideably supports) the motor 84 and/or the connector 122 as the motor 84 and/or the connector 122 move along the axial axis 4. In particular, the motor 84 (e.g., a motor housing of the motor 84) may be coupled (e.g., fixed, via one or more fasteners) to a bracket 126 that is slideably coupled (e.g., via a sliding interface 128, such as a tongue and groove interface) to a support structure 130 (e.g., frame, rod) of the carriage system 124. The support structure 130 may be coupled (e.g., fixed, via one or more fasteners) to the bonnet 60.

The remote locking assembly 30 may include certain features that provide a compact structure. For example, in the illustrated embodiment, the remote locking assembly 30 is positioned within a lateral extent of the bonnet 60 (e.g., does not extend outwardly from the bonnet 60 along the lateral axis 6) and is also positioned within a vertical extent of the bonnet 60 (e.g., does not extend outwardly from the bonnet 60 along the vertical axis 2). Additionally, the motor 84 is aligned with the locking mechanism 70 (e.g., respective central or rotational axes are aligned; coaxial) and positioned between fasteners 96 of the bonnet 60 so as to avoid contact with the fasteners 96 as the motor 84 moves with the locking mechanism 70 along the axial axis 4 toward the central bore 56 of FIG. 2 (e.g., while the remote locking assembly 30 locks the BOP 28 in the closed configuration). For example, the motor 84 is between the fasteners 96 along the lateral axis 6 with respect to the fasteners 96.

In some embodiments, the remote locking assembly 30 may include control components that may be part of the controller 34 of FIG. 1. For example, the remote locking assembly 30 may include a processing component that is configured to receive a control signal (e.g., from a remote base station). Upon receipt of the control signal, the control components may activate the motor 84 to adjust the locking mechanism 70 in the manner disclosed herein. It should be appreciated that any embodiment of the remote locking assembly 30 disclosed herein may include control components (e.g., disposed at or adjacent to the motor 84). It should also be appreciated that the remote locking assembly 30 of FIGS. 13 and 14 may be retrofitted to existing BOPs and/or may be used in any of the manners discussed above (e.g., removable).

Advantageously, the remote locking system disclosed herein may be utilized with a BOP, such as a BOP of an offshore system or an on-shore system. Thus, the remote locking system may be configured for use in a subsea environment and/or may have features that enable the remote locking system to be efficiently operated in a subsea environment or another remote environment even while the remote locking system is not physically accessible by an operator (e.g., manually by an operator, an ROV, and/or an AUV). For example, the remote locking assembly may be controlled via a controller in response to inputs at a remote base station (e.g., at a platform at a sea surface) that is physically separate from the remote locking assembly of the remote locking system. It should be appreciated that the remote locking system disclosed herein may be used with any of a variety of types of BOP's, including BOP's that have only a single ram (e.g., that seal the central bore with only the single ram; without an opposed ram). It should also be appreciated that any of the features disclosed above with respect to FIGS. 1-14 may be combined in any suitable manner.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A remote locking system for a blowout preventer (BOP), comprising:

a locking mechanism configured to move to adjust the remote locking system between an unlocked configuration in which the remote locking system enables movement of a ram of the BOP and a locked configuration in which the remote locking system blocks movement of the ram of the BOP;

a gear assembly coupled to the locking mechanism;

a motor coupled to the gear assembly; and an electronic controller configured to provide a control signal to activate the motor to drive the locking mechanism to move via the gear assembly, wherein the gear assembly and the motor are configured to move axially with the locking mechanism.

2. The remote locking system of claim 1, wherein the locking mechanism comprises a lock screw.

3. The remote locking system of claim 1, wherein a respective central axis of the locking mechanism is transverse to a respective central axis of an output shaft of the motor.

4. The remote locking system of claim 1, wherein the gear assembly comprises a bend.

5. The remote locking system of claim 1, wherein the gear assembly comprises a first gear, a second gear, and a belt coupled the first gear and the second gear.

6. The remote locking system of claim 5, wherein the first gear comprises a first diameter, the second gear comprises a second diameter, and the first diameter is smaller than the second diameter.

7. The remote locking system of claim 5, wherein the second gear is coaxial with the locking mechanism.

8. The remote locking system of claim 1 further comprising a gear housing configured to enclose at least a portion of the gear assembly.

9. The remote locking system of claim 1, wherein the motor comprises a hydraulic motor.

10. The remote locking system of claim 1 further comprising a manual lock to enable the locking mechanism to be manually moved to adjust the remote locking system between the unlocked configuration and the locked configuration.

11. A method of operating the remote locking system of claim 1, the method comprising:

remotely actuating the locking mechanism to lock the ram of the BOP relative to a central bore of the BOP.

12. The method of claim 11, wherein remotely actuating the locking mechanism comprises providing the control signal to activate the motor to thereby drive rotation of the locking mechanism relative to the ram of the BOP to drive axial movement of the locking mechanism toward the ram of the BOP.

13. A blowout preventer (BOP) system, comprising:

a ram configured to move relative to a central bore of the BOP system to adjust the BOP system between an open position and a closed position;

a bonnet configured to support an actuator to drive the ram to move relative to the central bore of the BOP system; and a locking mechanism configured to move along an axial axis relative to the bonnet;

a gear assembly coupled to the locking mechanism;

a motor coupled to the gear assembly; and an electronic controller configured to remotely activate the motor to drive the locking mechanism to move via the gear assembly to thereby lock the ram in the closed position, wherein the gear assembly and the motor are configured to move with the locking mechanism along the axial axis relative to the bonnet.

14. The BOP system of claim 13, wherein the locking mechanism comprises a lock screw that is threadably coupled to the bonnet.

15. The BOP system of claim 14, wherein the motor is configured to drive the locking mechanism to rotate via the gear assembly to thereby cause the locking mechanism to move along the axial axis relative to the bonnet.

16. The BOP system of claim 13, wherein a respective central axis of the locking mechanism is transverse to a respective central axis of an output shaft of the motor.

17. The BOP system of claim 13, comprising a gear housing configured to enclose at least a portion of the gear assembly.

18. The BOP system of claim 13, wherein the gear assembly and the motor are positioned within a lateral extent of the BOP.

* * * * *